US009604474B2

(12) United States Patent
Murata

(10) Patent No.: US 9,604,474 B2
(45) Date of Patent: Mar. 28, 2017

(54) PRINTING UNIT AND PRINTER

(71) Applicant: Seiko Instruments Inc., Chiba-shi, Chiba (JP)

(72) Inventor: Tomohiro Murata, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/836,500

(22) Filed: Aug. 26, 2015

(65) Prior Publication Data

US 2016/0059589 A1 Mar. 3, 2016

(30) Foreign Application Priority Data

Sep. 2, 2014 (JP) ..... 2014-178522
Dec. 24, 2014 (JP) ..... 2014-260733

(51) Int. Cl.

| | |
|---|---|
| ***B41J 11/04*** | (2006.01) |
| ***B41J 2/32*** | (2006.01) |
| ***B41J 25/312*** | (2006.01) |
| ***B41J 3/407*** | (2006.01) |
| ***B41J 11/20*** | (2006.01) |

(Continued)

(52) U.S. Cl.

CPC ..... *B41J 11/04* (2013.01); *B41J 2/32* (2013.01); *B41J 3/4075* (2013.01); *B41J 11/20* (2013.01); *B41J 11/703* (2013.01); *B41J 15/042* (2013.01); *B41J 25/312* (2013.01); *B41J 2202/31* (2013.01)

(58) Field of Classification Search

CPC . B41J 11/04; B41J 11/703; B41J 11/20; B41J 15/042; B41J 3/4075; B41J 25/312; B41J 2/32; B41J 2202/31

See application file for complete search history.

(56) References Cited

U.S. PATENT DOCUMENTS 5,964,541 A 10/1999 Murison et al.
6,155,731 A * 12/2000 Bertalan ..... B41J 15/042 101/227
6,249,302 B1 6/2001 Sekiya
(Continued)

FOREIGN PATENT DOCUMENTS

EP 0 322 919 A2 8/1989
EP 1 862 322 A1 12/2007
(Continued)

OTHER PUBLICATIONS

Extended Search Report in corresponding European Application No. 15183457.9, dated Oct. 6, 2016, 11 pages.

*Primary Examiner* — Julian Huffman
*Assistant Examiner* — Michael Konczal
(74) *Attorney, Agent, or Firm* — Brinks Gilson & Lione

(57) ABSTRACT

A printing unit comprises: a head unit; and a platen unit to be combined with the head unit. The platen unit includes: a pair of shaft support portions configured to individually support both end portions of the platen roller; and a coupling portion configured to bridge the pair of shaft support portions. The head unit includes an abutment portion provided to the head unit, which is configured to come into abutment against the coupling portion of the platen frame when the platen frame is located at the mounting position. A pressure-applying mechanism is provided between the platen frame and the subframe, which is configured to apply a pressure to the platen frame toward the abutment portion.

10 Claims, 11 Drawing Sheets

(51) Int. Cl.
*B41J 11/70* (2006.01)
*B41J 15/04* (2006.01)

(56) References Cited

U.S. PATENT DOCUMENTS 7,828,490 B2 * 11/2010 Nihashi ..... B41J 2/32
347/171
8,277,134 B2 10/2012 Kawaguchi

FOREIGN PATENT DOCUMENTS

EP 2 159 066 A2 3/2010
JP 2000-318260 A 11/2000
JP 2009-269319 A 11/2009

* cited by examiner

PRINTING UNIT AND PRINTER

RELATED APPLICATIONS

This application claims priority under 35 U.S.C. §119 to Japanese Patent Application Nos. 2014-178522 and 2014-260733 filed on Sep. 2, 2014 and Dec. 24, 2014, respectively, the entire contents of which are hereby incorporated by reference.

BACKGROUND OF THE INVENTION

1. Field of the Invention

The present invention relates to a printing unit and a printer.

2. Description of the Related Art

Hitherto, a thermal printer has been known as a printer for printing on a recording sheet (heat-sensitive paper). The thermal printer includes a printing unit that can be reduced in size and weight, and has a simple configuration without using toner or ink. Therefore, the thermal printer is employed for cash registers or mobile terminal devices to be widely used to print various labels, receipts, and tickets.

As the printing unit described above, a so-called "separate-type" printing unit is known. In the separate-type printing unit, for example, a head frame for supporting a thermal head is mounted to a casing main body for receiving a roll sheet therein, whereas a platen frame for supporting a platen roller is mounted to a printer cover that is coupled to the casing main body through an intermediation of a hinge portion so that the printer cover can be operated to be opened and closed.

The above-mentioned separate-type printing unit includes a lock mechanism for maintaining a pressure-contact state between the platen roller and the thermal head when the printer cover is located at a closed position. As the above-mentioned lock mechanism, there is known, for example, a configuration in which engagement concave portions for individually receiving both end portions of the platen roller are formed on the head frame. According to the configuration described above, along with the closing operation of the printer cover, both the end portions of the platen roller are respectively received in the engagement concave portions. At the same time, the thermal head is pressed toward the platen roller by a biasing member to allow the platen roller to be engaged in the engagement concave portions.

On the other hand, in order to disengage the platen roller and the engagement concave portions from each other in the configuration described above, one of the end portions of the platen roller is pushed up by a releasing lever provided to the head frame in a direction of disengaging from the engagement concave portion. At this time, a push-up force exerted on the one end portion of the platen roller is transmitted to the other end portion of the platen roller through the platen frame and the printer cover to disengage both the end portions of the platen roller from the engagement concave portions.

Further, there is known a printing unit comprising a cutter mechanism for cutting a printed recording sheet. The cutter mechanism includes, for example, a movable blade incorporated into the above-mentioned head frame side and a fixed blade incorporated into the above-mentioned platen frame side. According to this configuration, the movable blade is moved in a sliding manner with respect to the fixed blade so as to cut the recording sheet interposed between the movable blade and the fixed blade.

In the configuration described above, however, it is difficult to reliably disengage the platen roller and the engagement concave portions from each other. Specifically, when the push-up force exerted on the one end portion of the platen roller is transmitted to the other end portion of the platen roller through the platen frame and the printer cover, there is a problem in that the printer cover is twisted by the push-up force to cause difficulty in sufficiently transmitting the push-up force to the other end portion of the platen roller. In this case, there is a fear of occurrence of so-called "single-side opening" corresponding to the disengagement of only one end portion of the platen roller from the engagement concave portion. On the other hand, a configuration of reinforcing the printer cover to facilitate the transmission of the push-up force to the other end portion of the platen roller is also conceivable. In this case, however, there is a problem in that the configuration described above disadvantageously leads to rise in manufacturing cost.

Further, as the lock mechanism, for example, there is known a configuration including a pair of lock arms for individually holding both the end portions of the platen roller in concave portions formed on the head frame. According to this configuration, the lock arms are respectively separated away from both the end portions of the platen roller in conjunction with the operation of the releasing lever or the like, thereby enabling the platen roller from being easily disengaged from the concave portions. With the configuration of the lock mechanism described above, however, the lock arms are required to be additionally provided. Therefore, there is a problem in that the configuration disadvantageously leads to increase in number of components and rise in manufacturing costs.

Further, in the cutter mechanism described above, in order to ensure good cutting ability for the recording sheet, a positional relationship between the movable blade and the fixed blade is required to be set so that the fixed blade and the movable blade come into contact with each other at a proper contact pressure when the movable blade slides. To meet such a requirement, there is known, for example, a configuration including a biasing member for biasing the fixed blade so that a cutting edge of the fixed blade is pressed against the movable blade.

In the separate-type printing unit, however, the positional relationship between the movable blade and the fixed blade depends on positional accuracy of the printer cover and the casing main body (such as a position of the hinge portion). For example, an angle of the fixed blade changes depending on the position (height) of the hinge portion with respect to the platen roller. Therefore, when the positional accuracy of the printer cover and the casing main body is low, it is difficult to position the fixed blade and the movable blade with high accuracy when the printer cover is located at the closed position. Thus, there is a fear of lowering the cutting ability.

In view of the matters described above, a printing unit and a printer, which are capable of providing excellent operability while preventing the number of components and manufacturing costs from being increased and positioning the movable blade and the fixed blade with high accuracy to provide excellent cutting ability, are desired in the field of art.

SUMMARY OF THE INVENTION

According to one embodiment of the present invention, there is provided a printing unit, comprising: a head unit including a thermal head on which a plurality of heating elements are arranged; a platen unit to be combined with the head unit so as to be separable from each other, the platen unit including a platen roller configured to feed a recording sheet; a platen frame provided to the platen unit, the platen frame including: a pair of shaft support portions configured to individually support both end portions of the platen roller; and a coupling portion configured to bridge the pair of shaft support portions; a subframe provided to the platen unit, which is configured to movably support the platen frame; engagement concave portions formed on the head unit, which are configured to individually receive both the end portions of the platen roller and to hold the platen frame in a mounting position; a releasing lever provided to the head unit, which is configured to press a portion of the platen frame, which is located on a side of one of the pair of shaft support portions, in a direction of disengaging the platen roller from the engagement concave portions; an abutment portion provided to the head unit, which is configured to come into abutment against the coupling portion of the platen frame when the platen frame is located at the mounting position; and a pressure-applying mechanism provided between the platen frame and the subframe, which is configured to apply a pressure to the platen frame toward the abutment portion.

According to the configuration described above, when the platen unit is separated from the head unit, the releasing lever is first operated to press the portion of the platen unit, which is located on the one shaft support portion side, in a separating direction. Then, the platen frame pivots about the abutment portion as a fulcrum in the separating direction with respect to the subframe. As a result, the platen roller is disengaged from the engagement concave portions. Thereafter, the platen roller and the engagement concave portions are disengaged from each other to release the combination of the head unit and the platen unit. In this case, the pressure is applied to the platen frame by the pressure-applying mechanisms toward the abutment portions. Therefore, when the platen frame is pressed by the releasing lever, an abutment state between the platen frame and the abutment portions is maintained to prevent the platen frame from being lifted up from the abutment portions. Therefore, a push-up force exerted by the releasing lever on the portion of the platen frame, which is located on the one shaft support portion side, is transmitted to the other shaft support portion through the coupling portion. As a result, both the end portions of the platen roller are disengaged from the engagement concave portions.

As described above, the pressing force of the releasing lever can be efficiently transmitted to both the shaft support portions. Therefore, the occurrence of "single-side opening" can be suppressed to reliably separate the head unit and the platen unit from each other. In this case, reinforcement of the printer cover to which the platen unit is mounted or lock arms, which are hitherto required, are not required. Therefore, the number of components and manufacturing costs can be prevented from increasing. In addition, the platen unit (platen frame) and the head unit come into abutment against each other through the abutment portions. Therefore, the platen unit and the head unit can be kept at the same potential to prevent the occurrence of secondary discharge.

In the printing unit according to the one embodiment of the present invention, when the platen frame is pushed up by the releasing lever, the releasing lever presses a portion of the platen frame, which is located on a side close to the platen roller with respect to the abutment portion, and the pressure-applying mechanism presses a portion of the platen frame, which is located on a side opposite to the platen roller with respect to the abutment portion.

According to the configuration described above, the abutment state between the platen frame and the abutment portions can be reliably maintained to more efficiently transmit the pressing force of the releasing lever to both the shaft support portions.

The printing unit according to the one embodiment of the present invention further comprises: a fixed blade provided to one of the head unit and the platen frame; and a movable blade provided to another of the head unit and the platen frame so as to be slidable, which is configured to cut the recording sheet in cooperation with the fixed blade.

According to the configuration described above, the platen frame comes into abutment against the abutment portion of the head unit as described above. Therefore, in the state in which the platen unit and the head unit are mounted, the platen unit and the head unit are positioned in predetermined positions. Specifically, the platen unit and the head unit are positioned in at least two positions, that is, a coupling portion between the platen roller and the engagement concave portions and an abutment portion between the platen frame and the abutment portion of the head unit. Therefore, the head unit and the platen unit can be positioned with high accuracy. In particular, the platen frame is biased toward the abutment portion by the pressure-applying mechanism. Thus, even when there is a variation in position of a hinge portion with respect to the platen roller, the positional variation can be absorbed by the amount of deformation of the pressure-applying mechanism. Therefore, the abutment state between the platen frame and the abutment portion is maintained so that the head unit and the platen unit are positioned with high accuracy. Thus, the fixed blade provided to the one of the head unit and the platen frame and the movable blade provided to the other can be positioned with high accuracy. As a result, excellent cutting performance can be provided.

In the printing unit according to the one embodiment of the present invention, the subframe supports the platen frame movably through an intermediation of the platen roller.

According to the configuration described above, the subframe is supported by the platen frame through an intermediation of the platen roller. Therefore, as compared with a case where the subframe is supported by the platen frame through an intermediation of a member other than the platen roller, the number of components can be prevented from increasing.

According to one embodiment of the present invention, there is provided a printer, comprising the printing unit described above, in which: the head unit is mounted to a casing main body including a recording sheet receiving portion configured to receive the recording sheet therein; and the platen unit is mounted to a printer cover through an intermediation of the subframe, the printer cover being configured to be pivotally coupled to the casing main body through an intermediation of a hinge portion to open and close the recording sheet receiving portion.

According to the configuration described above, the printer includes the above-mentioned printing unit. Therefore, excellent operability can be provided, while the number of components and manufacturing costs are prevented from increasing.

According to one embodiment of the present invention, there is provided a printer, comprising: a casing main body including a recording sheet receiving portion configured to receive a recording sheet therein; a head unit including a thermal head mounted to the casing main body; a printer cover configured to be pivotally coupled to the casing main body through an intermediation of a hinge portion to open and close the recording sheet receiving portion; a platen unit to be mounted to the printer cover and to be combined separably to the head unit when the printer cover is located at a closed position; a platen roller provided to the platen unit, which is configured to feed the recording sheet; a platen frame including: a pair of shaft support portions provided to the platen unit, which is configured to individually support both end portions of the platen roller; and a coupling portion configured to bridge the pair of shaft support portions, the platen frame being supported so as to be movable with respect to the printer cover; engagement concave portions formed on the head unit, which are configured to individually receive both the end portions of the platen roller and to hold the platen frame in a mounting position; a releasing lever provided to the head unit, which is configured to press a portion of the platen frame, which is located on a side of one of the pair of shaft support portions, in a direction of disengaging the platen roller from the engagement concave portions; an abutment portion provided to the head unit, which is configured to come into abutment against the coupling portion of the platen frame when the platen frame is located at the mounted portion; and a pressure-applying mechanism provided between the printer cover and the platen frame, which is configured to apply a pressure to the platen frame toward the abutment portion.

According to the configuration described above, the printer has the same configuration as those of the printing unit described above and the printer comprising the printing unit. Thus, the same actions and effects as those of the printing unit and the printer can be obtained.

As described above, according to the printing unit and the printer of the one embodiment of the present invention, excellent operability can be provided, while the number of components and manufacturing costs are prevented from increasing.

DETAILED DESCRIPTION OF THE PREFERRED EMBODIMENTS

An embodiment of the present invention is now described referring to the accompanying drawings.

Figure 1:
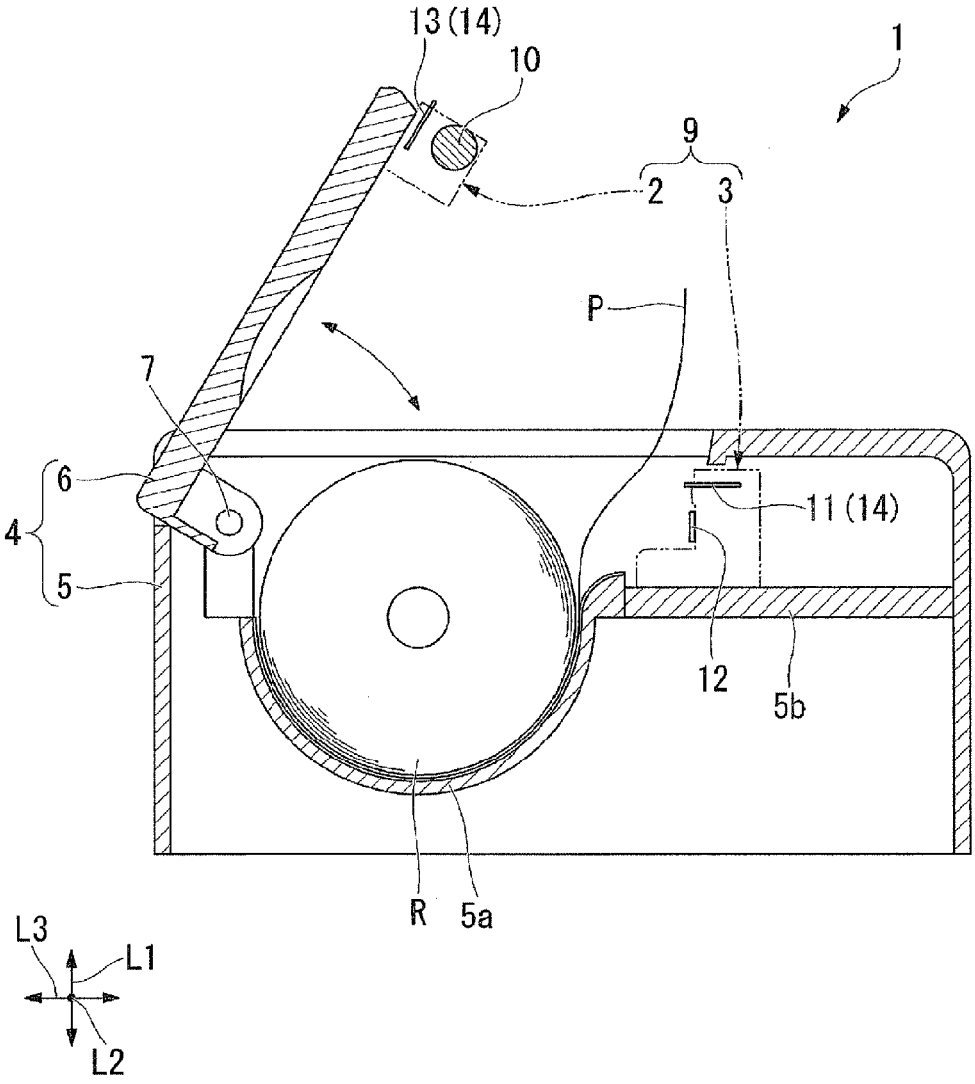
FIG. 1 is a sectional view of a thermal printer, for illustrating a state in which a printing unit is incorporated into a casing when a printer cover is located at an opened position.
Figure 2:
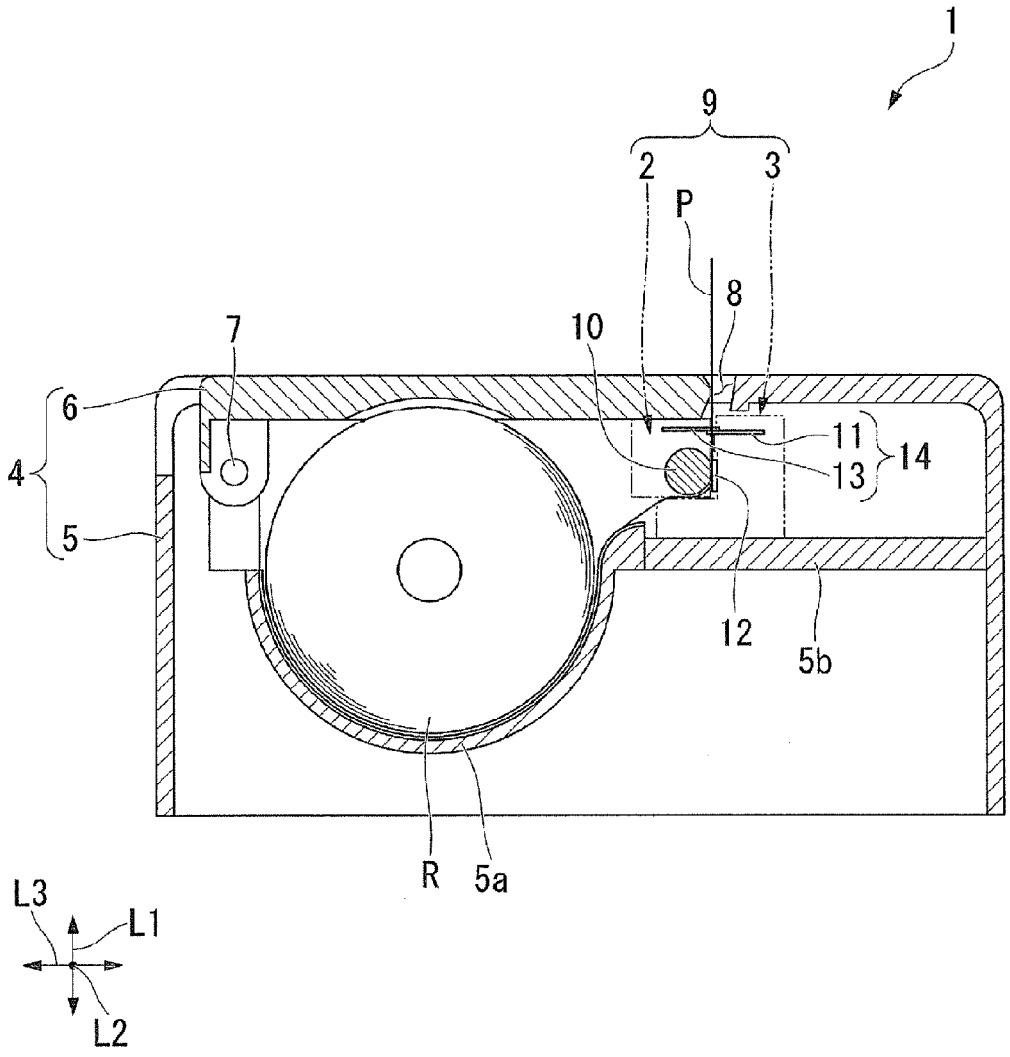
FIG. 2 is a sectional view of the thermal printer, for illustrating a state in which the printing unit is incorporated into the casing when the printer cover is located at a closed position.

FIG. 1 and FIG. 2 are sectional views of a thermal printer 1. FIG. 1 is an illustration of a state in which a printer cover 6 is located at an opened position, whereas FIG. 2 is an illustration of a state in which the printer cover 6 is located at a closed position. In this embodiment, in an example illustrated in FIG. 1, a vertical direction in the drawing sheet is simply referred to as "vertical direction L1", a direction orthogonal to the drawing sheet is referred to as "horizontal direction L2", and a direction orthogonal to the vertical direction L1 and the horizontal direction L2 is referred to as "longitudinal direction L3". As illustrated in FIG. 1 and FIG. 2, the thermal printer 1 of this embodiment includes a printing unit 9 and a casing 4. The printing unit 9 includes a platen unit 2 and a head unit 3, which are combined with each other separably. The printing unit 9 is incorporated into the casing 4 that also receives a roll sheet R obtained by rolling a recording sheet P therein.

The casing 4 includes a casing main body 5 and a printer cover 6. The casing main body 5 includes a roll sheet receiving portion 5*a* for receiving the roll sheet R therein. The printer cover 6 opens and closes the roll sheet receiving portion 5*a*. The printer cover 6 is coupled pivotally to the casing main body 5 through an intermediation of a hinge portion 7. Further, as illustrated in FIG. 2, a discharge port 8 for discharging the recording sheet P externally (upward) is formed between an opening edge of the roll sheet receiving portion 5*a* and a distal end portion of the printer cover 6 when the printer cover 6 is located at the closed position.

The platen unit 2 described above is a unit having a platen roller 10 and a fixed blade 13 mainly incorporated therein, and is mounted to an inner surface of a distal end portion of the printer cover 6. Therefore, through movement along with an opening and closing operation of the printer cover 6, the platen unit 2 is separably combined with the head unit 3. On the other hand, the head unit 3 is, for example, a unit having a thermal head 12 and a movable blade 11 mainly incorporated therein, and is mounted to the casing main body 5. In the illustrated example, the head unit 3 is fixed on an inner plate 5*b* provided so as to be adjacent to the roll sheet receiving portion 5*a* so that the thermal head 12 is oriented toward the roll sheet receiving portion 5*a*.

When the printer cover 6 is closed to combine the platen unit 2 and the head unit 3 with each other, the thermal head 12 is pressed against the platen roller 10, as illustrated in FIG. 2. At the same time, the movable blade 11 partially overlaps the fixed blade 13. The fixed blade 13 and the movable blade 11 form a cutter mechanism 14.

Figure 3:
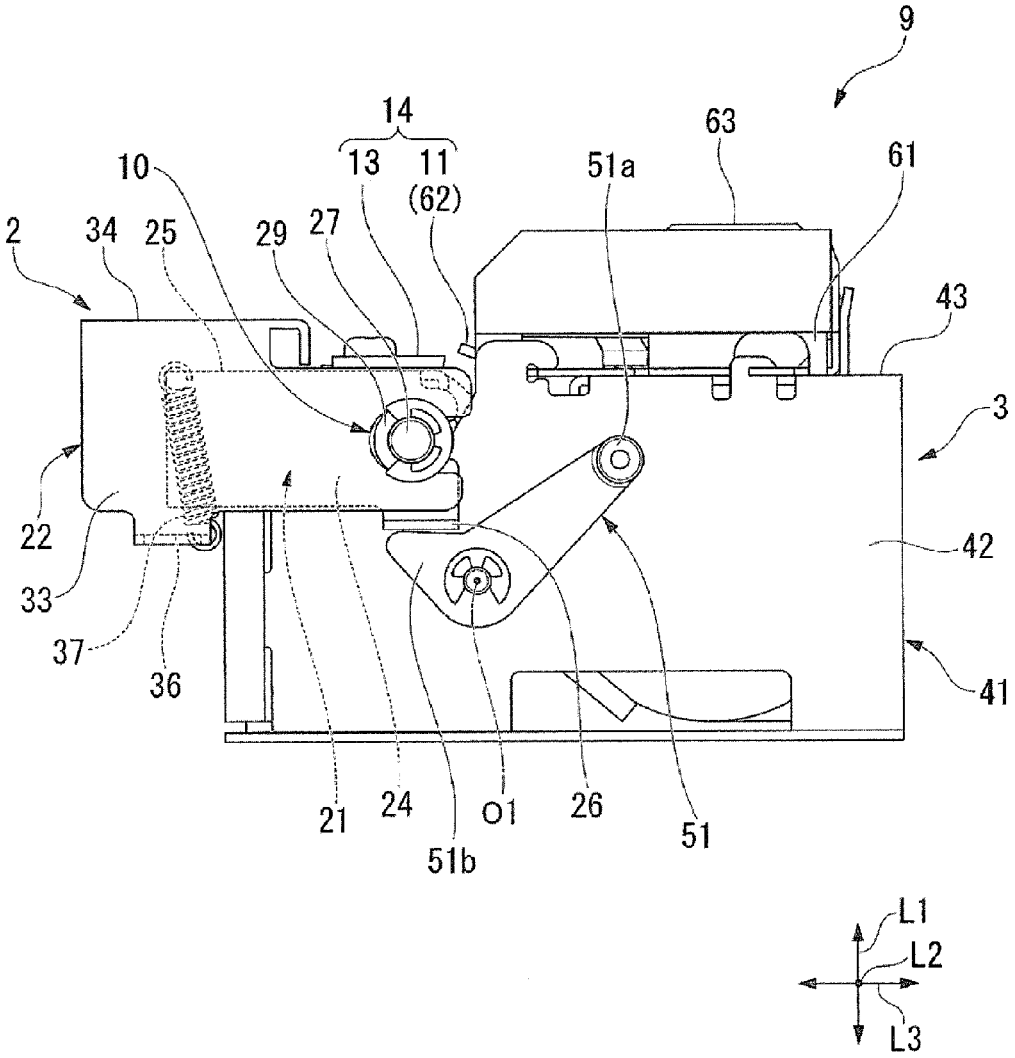
FIG. 3 is a side view of the printing unit.
Figure 4:
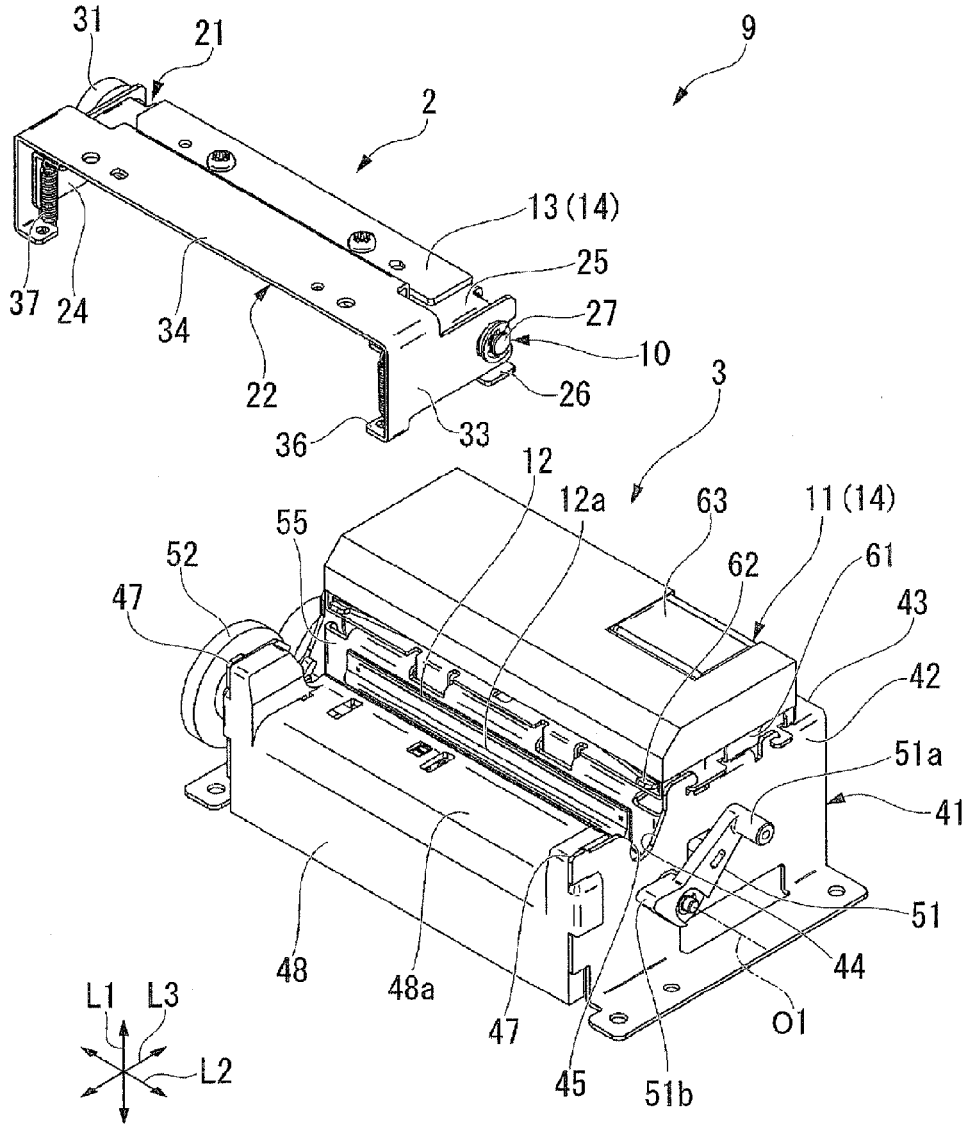
FIG. 4 is an exploded perspective view of the printing unit.
Figure 5:
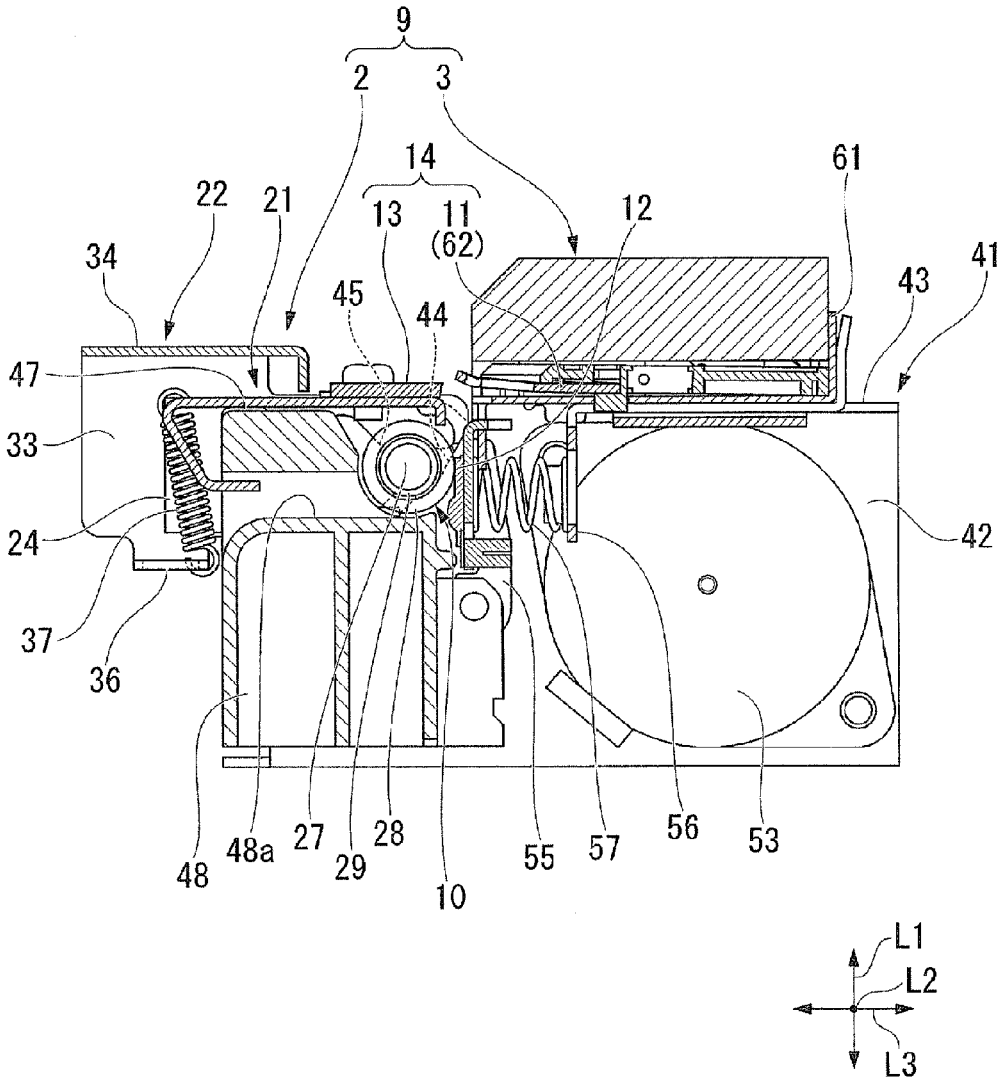
FIG. 5 is a sectional view of the printing unit.
Figure 6:
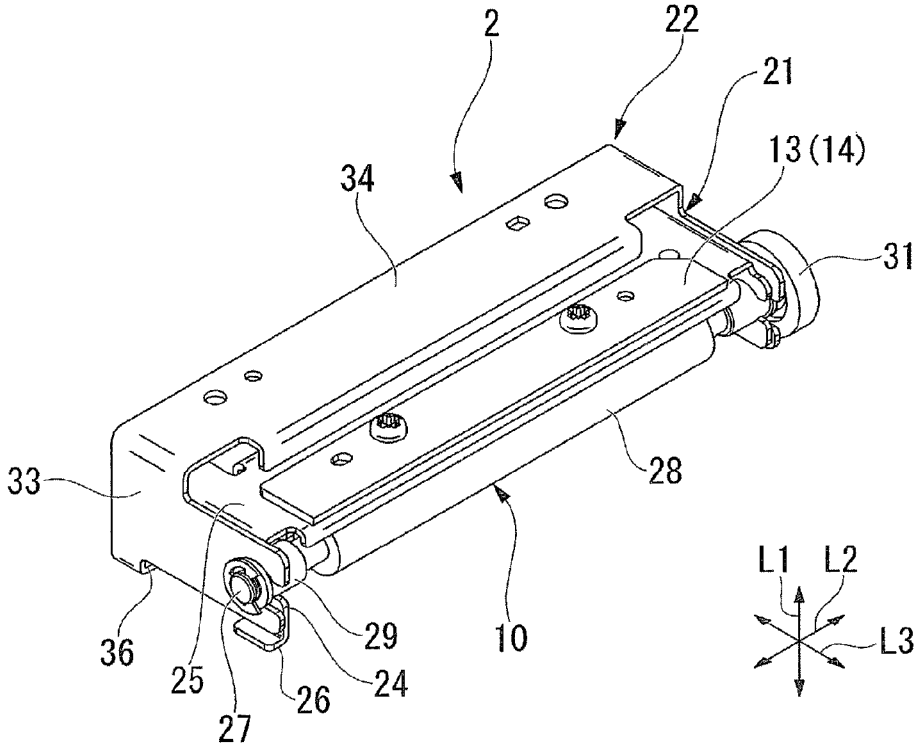
FIG. 6 is a perspective view of a platen unit.

FIG. 3 is a side view of the printing unit 9, and FIG. 4 is an exploded perspective view of the printing unit 9. FIG. 5 is a sectional view of the printing unit 9, and FIG. 6 is a perspective view of the platen unit 2. As illustrated in FIG. 3 to FIG. 6, the platen unit 2 includes the platen roller 10 and the fixed blade 13, which are described above, a platen frame 21, and a subframe 22. The platen frame 21 supports the platen roller 10 and the fixed blade 13. The subframe 22 supports the platen frame 21.

First, the platen frame 21 is formed by bending a plate material made of a metal or the like, and has a U-like shape that is open downward in front view as viewed in the longitudinal direction L3. Specifically, the platen frame 21 includes a pair of shaft support portions 24 and a coupling portion 25. The shaft support portions 24 are respectively located on both end portions in the horizontal direction L2. The coupling portion 25 extends along the horizontal direction L2 and bridges the shaft support portions 24. A bearing 29 for the platen roller 10, which is described later, is held in one end portion of each of the shaft support portions 24 in the longitudinal direction L3. A projecting piece 26 that projects outward in the horizontal direction L2 is formed on a lower end portion of one of the shaft support portions 24, which is located on one end side in the horizontal direction L2.

The platen roller 10 is arranged so that an outer circumferential surface thereof comes into contact with the thermal head 12 of the head unit 3 in a state in which the recording sheet P is nipped between the platen unit 2 and the head unit 3 when the platen unit 2 and the head unit 3 are combined with each other while the printer cover 6 is in the closed position. Specifically, the platen roller 10 includes a platen shaft 27 and a roller main body 28. The platen shaft 27 extends along the horizontal direction L2. The roller main body 28 is made of a rubber or the like, and is mounted on the platen shaft 27.

The bearings 29 are respectively mounted on both end portions of the platen shaft 27. As described above, each of the bearings 29 is held by the platen frame 21. Through an intermediation of the bearings 29, the platen roller 10 is rotatably supported by the platen frame 21. Further, a platen gear 31 is mounted on the other end portion of the platen shaft 27 (portion of the platen shaft 27, which is located on the outer side of the bearing 29 on the other end side in the horizontal direction L2) (see FIG. 4). In the following description, "one end side" in the horizontal direction L2 is defined as a side of the platen unit 2 in the horizontal direction L2 where the projecting piece 26 is provided, whereas "the other end side" in the horizontal direction L2 is defined as a side of the platen unit 2 in the horizontal direction L2, which is opposite to the "one end side", that is, the side where the platen gear 31 is mounted. When the platen unit 2 and the head unit 3 are combined with each other, the platen gear 31 comes into meshing engagement with a platen driving gear 52 (see FIG. 4) provided to the head unit 3, which is described later, to transmit a rotating force to the platen roller 10. In this manner, the recording sheet P can be fed while being nipped between the platen roller 10 and the thermal head 12.

The fixed blade 13 has a plate-like shape extending along the horizontal direction L2, and is fixed onto the coupling portion 25 of the platen frame 21 in a state in which a cutting edge of the fixed blade 13 is oriented to one end side in the longitudinal direction L3.

The subframe 22 is slightly larger than the platen frame 21, and surrounds the platen frame 21 on an upper side and both sides in the horizontal direction L2. Specifically, the subframe 22 includes side wall portions 33 and a base portion 34. The side wall portions 33 are located on both sides in the horizontal direction L2. The base portion 34 couples the side wall portions 33. Each of the bearings 29 for the platen roller 10 is inserted loosely into one end portion of corresponding one of the side wall portions 33 in the longitudinal direction L3. In this manner, the subframe 22 supports the platen frame 21 so as to be rotatable and movable within a plane orthogonal to the horizontal direction L2 through an intermediation of the platen roller 10. Further, a bent piece 36, which is bent inward in the horizontal direction L2, is formed on the other end portion of each of the side wall portions 33 in the longitudinal direction L3. In the following description, "one end side" in the longitudinal direction L3 is defined as the side of the platen unit 2 where the bearings 29 are provided, whereas "the other end side" in the longitudinal direction L3 is defined as the side of the platen unit 2 where the bent piece 36 is formed.

Between the platen frame 21 and the subframe 22, a pair of pressure-applying mechanisms 37 for biasing (applying a pressure to) the platen frame 21 about the platen shaft 27 in a direction away from the subframe 22 (downward) is interposed. Each of the pressure-applying mechanisms 37 is formed of, for example, a coil spring extending in the vertical direction L1. A lower end portion of each of the pressure-applying mechanisms 37 is individually coupled to the corresponding bent piece 36 of the subframe 22, which is described above, whereas an upper end portion thereof is coupled to the coupling portion 25 of the platen frame 21. In this case, while the printer cover 6 is located at the opened position, the platen frame 21 is held in a state of being inclined with respect to the subframe 22 (see, for example, FIG. 8).

As illustrated in FIG. 3 to FIG. 5, the head unit 3 includes the thermal head 12 and the movable blade 11, which are described above, and a head frame 41. The head frame 41 supports the thermal head 12 and the movable blade 11.

The head frame 41 has a U-like shape in front view as viewed in the longitudinal direction L3. The head frame 41 includes a pair of side wall portions 42 and a top wall portion 43. The pair of side wall portions 42 located on both sides of the head frame 41 in the horizontal direction L2. The top wall portion 43 bridges upper end portions of the side wall portions 42. An engagement concave portion 44, with which corresponding one of the bearings 29 for the platen roller 10 is individually engaged, is formed on each of the side wall portions 42. The engagement concave portions 44 are open upward, and have a width along the longitudinal direction L3, which gradually decreases in a downward direction. Further, a stopper portion 45, which comes into engagement with the corresponding one of the bearings 29 for the platen roller 10 from above when the printer cover 6 is located at the closed position, is formed on an inner circumferential edge of the engagement concave portion 44 so as to project to the one end side in the longitudinal direction L3.

Further, as illustrated in FIG. 5, a corner portion on an upper end portion of each of the side wall portions 42, which is located on the other end side in the longitudinal direction L3, forms an abutment portion 47 that abuts against the coupling portion 25 of the platen frame 21 in a state in which the platen unit 2 is combined with the head unit 3. Specifically, the abutment portions 47 correspond to both end portions of the coupling portion 25 of the platen frame 21 in the horizontal direction L2, and are formed so as to abut against portions of the coupling portion 25, which are located closer to the other end side than the platen roller 10 in the longitudinal direction L3.

Therefore, in a state in which the platen unit 2 is combined with the head unit 3, the pressure-applying mechanisms 37 described above bias (apply a pressure to) the platen frame 21 toward the abutment portions 47 so as to maintain an abutment state between the platen frame 21 and the abutment portions 47. In this manner, the platen roller 10 and the fixed blade 13, which are supported by the platen frame 21, are positioned in predetermined positions (specifically, a position that enables sheet feeding and a position that enables sheet cutting) with respect to the thermal head 12 and the movable blade 11. Further, at this time, a biasing force is exerted on the platen frame 21 in a direction in which the platen roller 10 is disengaged from the engagement concave portions 44 (disengagement direction) about each of the abutment portions 47 as a fulcrum. The biasing force of the pressure-applying mechanisms 37 is set so that the platen roller 10 is not disengaged from the engagement concave portions 44 by the biasing force alone and torsion does not occur in the printer cover 6 in a state in which the platen unit 2 and the head unit 3 are combined with each other.

As illustrated in FIG. 4 and FIG. 5, a guiding member 48 is provided at a portion located between the side wall portions 42 of the head frame 41. In a central portion of the guiding member 48 in the horizontal direction L2, a receiving portion 48*a* that is recessed downward is formed. The roller main body 28 of the platen roller 10 described above is received in the receiving portion 48*a* when the printer cover 6 is located at the closed position. The guiding member 48 is configured so that the recording sheet P passes between an outer circumferential surface of the roller main body 28 and a bottom surface of the receiving portion 48*a*.

As illustrated in FIG. 3 and FIG. 4, a releasing lever 51 for releasing the combination of the platen unit 2 and the head unit 3 is provided on one of the side wall portions 42 of the head frame 41, which is located on the one end side in the horizontal direction L2. The releasing lever 51 is formed to have a V-like shape in side view as viewed in the horizontal direction L2, and has a top portion pivotally supported about a pivot axis O1 extending along the horizontal direction L2. A portion of the releasing lever 51, which is located on one end side (The right side in FIG. 3) with respect to the top portion, forms a lever locking portion 51*a* to which a lever member (not shown) provided to the casing main body 5 is locked. With this configuration, the releasing lever 51 pivots in conjunction with an operation of the lever member. On the other hand, a portion of the releasing lever 51, which is located on the other end side (The left side in FIG. 3) with respect to the top portion, forms an abutment piece 51*b* that can come into abutment against the above-mentioned projecting piece 26 of the platen frame 21 from below. The abutment piece 51*b* pushes up the platen unit 2 through an intermediation of the projecting piece 26 when the releasing lever 51 pivots.

As illustrated in FIG. 4, a platen driving gear 52 is provided on one of the side wall portions 42, which is located on the other end side in the horizontal direction L2. The platen driving gear 52 comes into meshing engagement with the platen gear 31 of the platen unit 2 when the platen unit 2 and the head unit 3 are combined with each other. The platen driving gear 52 is connected to a platen driving motor 53 (see FIG. 5) mounted in the head frame 41 through an intermediation of a platen gear train mechanism (not shown). With this configuration, through appropriate rotation of the platen driving motor 53, a rotating force of the platen driving motor 53 is transmitted to the platen gear 31 through an intermediation of the platen gear train mechanism and the platen driving gear 52. As a result, the platen roller 10 can be rotated.

As illustrated in FIG. 4, the thermal head 12 is formed to have a plate-like shape extending along the horizontal direction L2 (sheet width direction of the recording sheet P), and is located closer to the one end side of the head frame 41 than the guiding member 48 in the longitudinal direction L3. On a surface of the thermal head 12, a plurality of heating elements 12*a* are arranged linearly. The heating elements 12*a* are located above a bottom surface of the receiving portion 48*a* of the guiding member 48, and are arranged so as to be opposed to the platen roller 10 when the printer cover 6 is located at the closed position. As illustrated in FIG. 5, the thermal head 12 is fixed to a head support body 55 that is supported pivotally by the guiding member 48. The head support body 55 is biased toward the other end side in the longitudinal direction L3 by a head biasing member 57. The head biasing member 57 is interposed between the head support body 55 and a support plate 56 that is provided to extend downward from the top wall portion 43 of the head frame 41. With this configuration, the thermal head 12 comes into pressure contact with the platen roller 10 when the printer cover 6 is located at the closed position.

As illustrated in FIG. 3 and FIG. 5, the movable blade 11 is provided at a position opposed to the fixed blade 13 across the recording sheet P in the longitudinal direction L3 when the printer cover 6 is closed to combine the head unit 3 and the platen unit 2 with each other. Specifically, the movable blade 11 includes a movable-blade frame 61, a movable-blade main body 62, and a driving mechanism 63. The movable-blade main body 62 is supported slidably by the movable-blade frame 61. The driving mechanism 63 drives the movable-blade main body 62.

The movable-blade frame 61 is fixed onto the top wall portion 43 of the head frame 41. The movable-blade main body 62 is formed to have a V-like shape in plan view as viewed in the vertical direction L1, and is formed so that a length from a bottom to a cutting edge is gradually reduced as approaching from both ends to the center.

The driving mechanism 63 includes a cutter motor and a gear train mechanism. The cutter motor can rotate both in a forward direction and in a reverse direction, and is mounted on the movable-blade frame 61. The gear train mechanism is connected between the cutter motor and the movable-blade main body 62. The movable-blade main body 62 moves slidably by transmission of a driving force of the cutter motor through an intermediation of the gear train mechanism.

Figure 7:
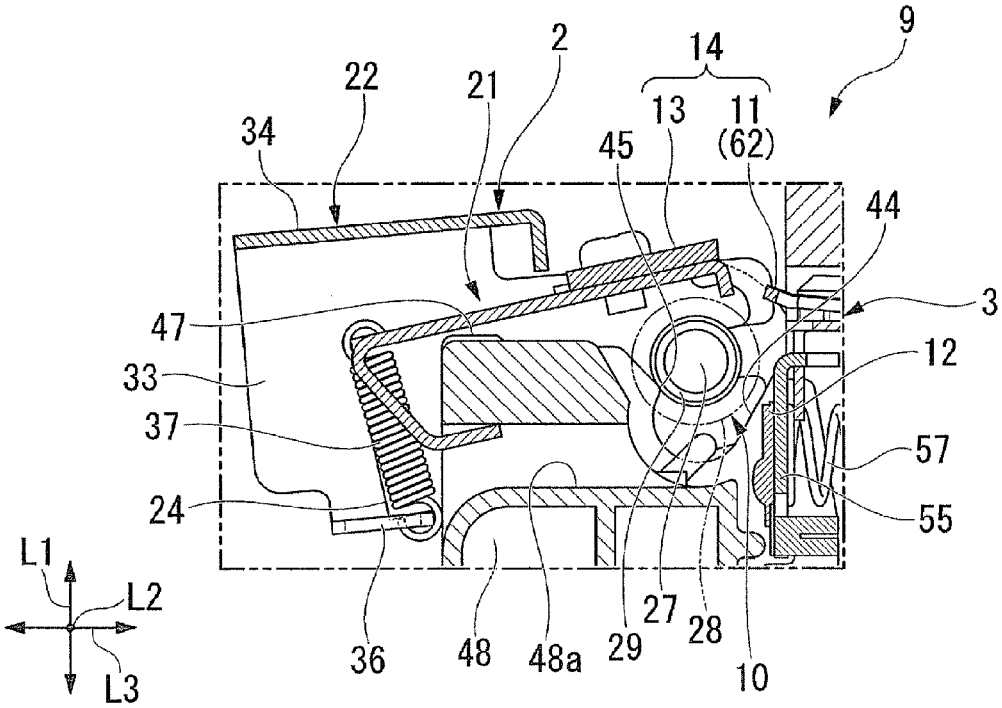
FIG. 7 is an explanatory view for illustrating an opening and closing operation of the thermal printer, which is a partial sectional view of FIG. 5.
Figure 8:
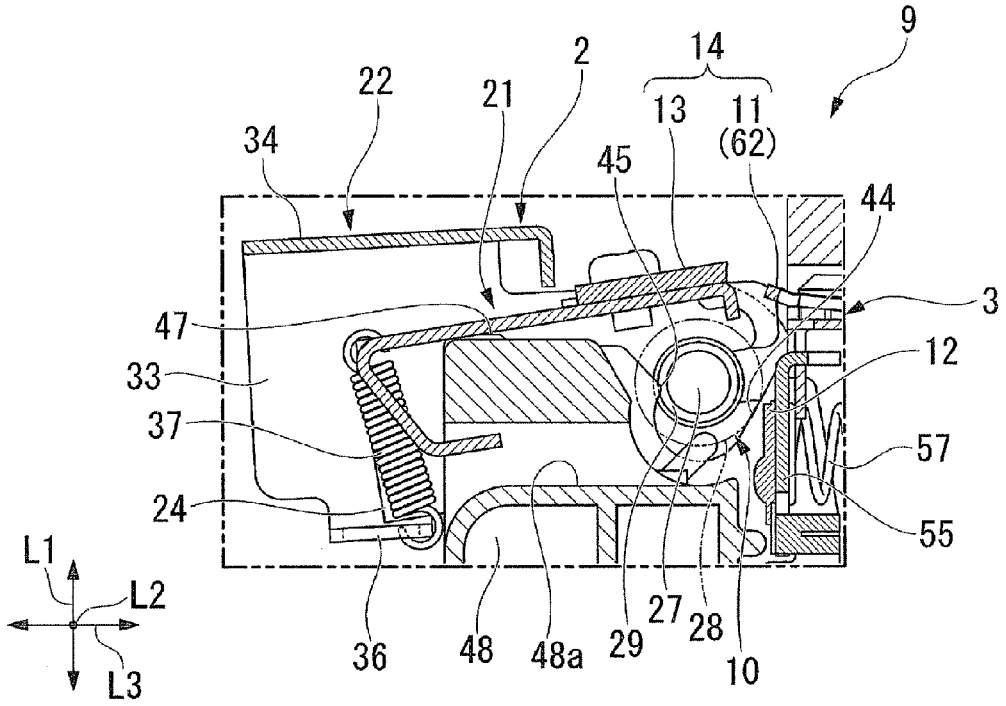
FIG. 8 is another explanatory view for illustrating the opening and closing operation of the thermal printer, which is a partial sectional view of FIG. 5.
Figure 9:
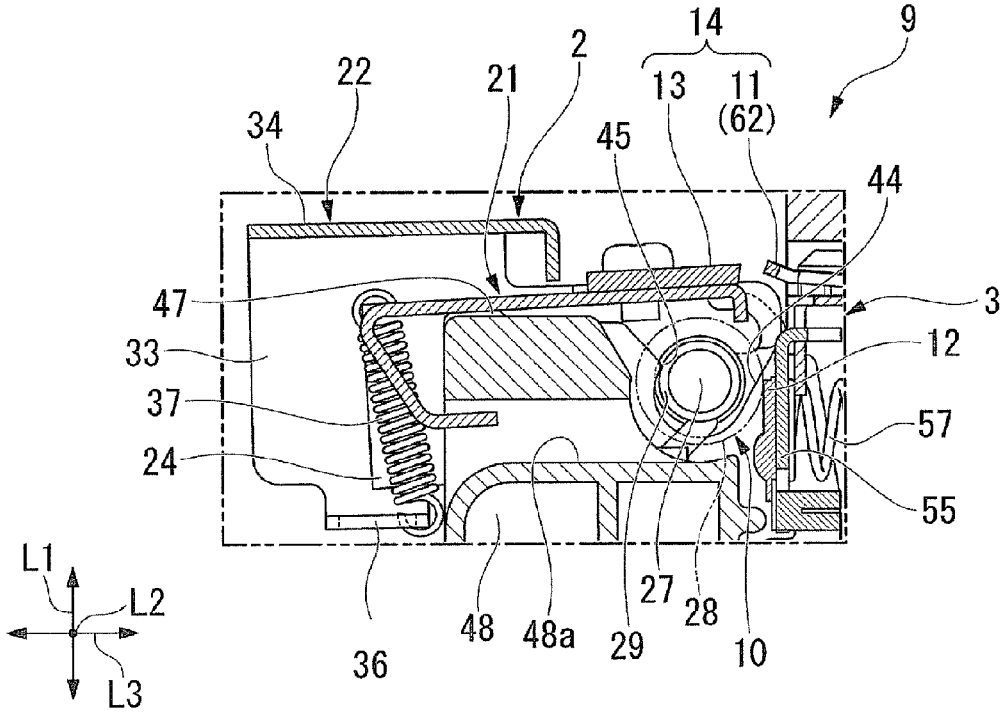
FIG. 9 is a further explanatory view for illustrating the opening and closing operation of the thermal printer, which is a partial sectional view of FIG. 5.

Next, actuation of the above-mentioned thermal printer 1 is described. FIG. 7 to FIG. 9 are explanatory views for illustrating an opening and closing operation of the thermal printer 1, and are partial sectional views of FIG. 5. First, the closing operation of the printer cover 6 is described. After the roll sheet R is loaded into the roll sheet receiving portion 5*a*, the printer cover 6 is closed. Then, as illustrated in FIG. 7, the bearings 29 for the platen roller 10 are respectively received in the engagement concave portions 44 of the head unit 3. Specifically, along with the closing operation of the printer cover 6, the coupling portion 25 of the platen frame 21 first abuts against the abutment portions 47 of the head frame 41. As illustrated in FIG. 8, when the printer cover 6 is further pushed in the closing direction in this state, the subframe 22 pivots together with the printer cover 6, while the platen frame 21 pivots about each of the abutment portions 47 as the fulcrum with respect to the printer cover 6 (subframe 22).

Then, the platen roller 10 moves down while the bearings 29 are sliding on inner circumferential edges of the engagement concave portions 44, respectively. Thereafter, as illustrated in FIG. 9, when the bearings 29 for the platen roller 10 move over the stopper portions 45, the outer circumferential surface of the roller main body 28 comes into contact with the thermal head 12 to press the thermal head 12 in a direction against the biasing force of the head biasing member 57 (toward the one end side in the longitudinal direction L3). Then, after the bearings 29 for the platen roller 10 move over the stopper portions 45 provided in the engagement concave portions 44, the roller main body 28 is pressed toward the other end side in the longitudinal direction L3 by the biasing force of the head biasing member 57 to hold the bearings 29 inside the engagement concave portions 44 in a state of being engaged with the stopper portions 45. As a result, as illustrated in FIG. 2 and FIG. 3, the printer cover 6 is located at the closed position, while the platen unit 2 is mounted to the head unit 3 to achieve a state in which the platen unit 2 and the head unit 3 are combined with each other. In the state in which the platen unit 2 and the head unit 3 are combined with each other, the pressure-applying mechanisms 37 bias the platen frame 21 toward the abutment portions 47 on the other end side in the longitudinal direction L3 with respect to the abutment portions 47.

In the state in which the platen unit 2 and the head unit 3 are combined with each other, in the platen unit 2, the platen roller 10 is held in the engagement concave portions 44, while the platen frame 21 is held in abutment against the abutment portions 47. Specifically, the platen unit 2 and the head unit 3 are positioned in at least two positions, that is, the coupling portion between the platen roller 10 and the engagement concave portions 44 and the abutment portion between platen frame 21 and the abutment portions 47 of the head unit 3. In particular, the platen frame 21 is biased toward the abutment portions 47 by the pressure-applying mechanisms 37. Therefore, even when there is a variation in position of the hinge portion 7 with respect to the platen roller 10, the positional variation can be absorbed by the amount of deformation of the pressure-applying mechanisms 37. Therefore, the abutment state between the platen frame 21 and the abutment portions 47 is maintained to position the head unit 3 and the platen unit 2 with high accuracy.

Then, in the state in which the platen unit 2 and the head unit 3 are combined with each other, the recording sheet P is nipped between the platen roller 10 and the thermal head 12. After passing between the movable blade 11 and the fixed blade 13, the recording sheet P is pulled out of the casing 4 through the discharge port 8. Further, the platen gear 31 of the platen unit 2 comes into meshing engagement with the platen driving gear 52 provided to the head unit 3.

Thereafter, the platen driving motor 53 is driven so that the rotating force of the platen driving motor 53 is transmitted to the platen gear 31 of the platen unit 2. As a result, the platen roller 10 can be rotated so that the recording sheet P can be fed while the recording sheet P is nipped between the platen roller 10 and the thermal head 12. Simultaneously with the sheet feeding, various letters and figures can be clearly printed on the recording sheet P that is being fed, by appropriately allowing the heating elements 12*a* of the thermal head 12 to generate heat.

The printed recording sheet P passes between the fixed blade 13 and the movable blade 11. Then, after the passage of the recording sheet P by a predetermined length, the driving mechanism 63 is driven to slide the movable-blade main body 62 toward the fixed blade 13. In this manner, the recording sheet P can be cut between the fixed blade 13 and the movable blade 11, As a result, the recording sheet P thus cut can be used as a receipt or a ticket.

Figure 10:
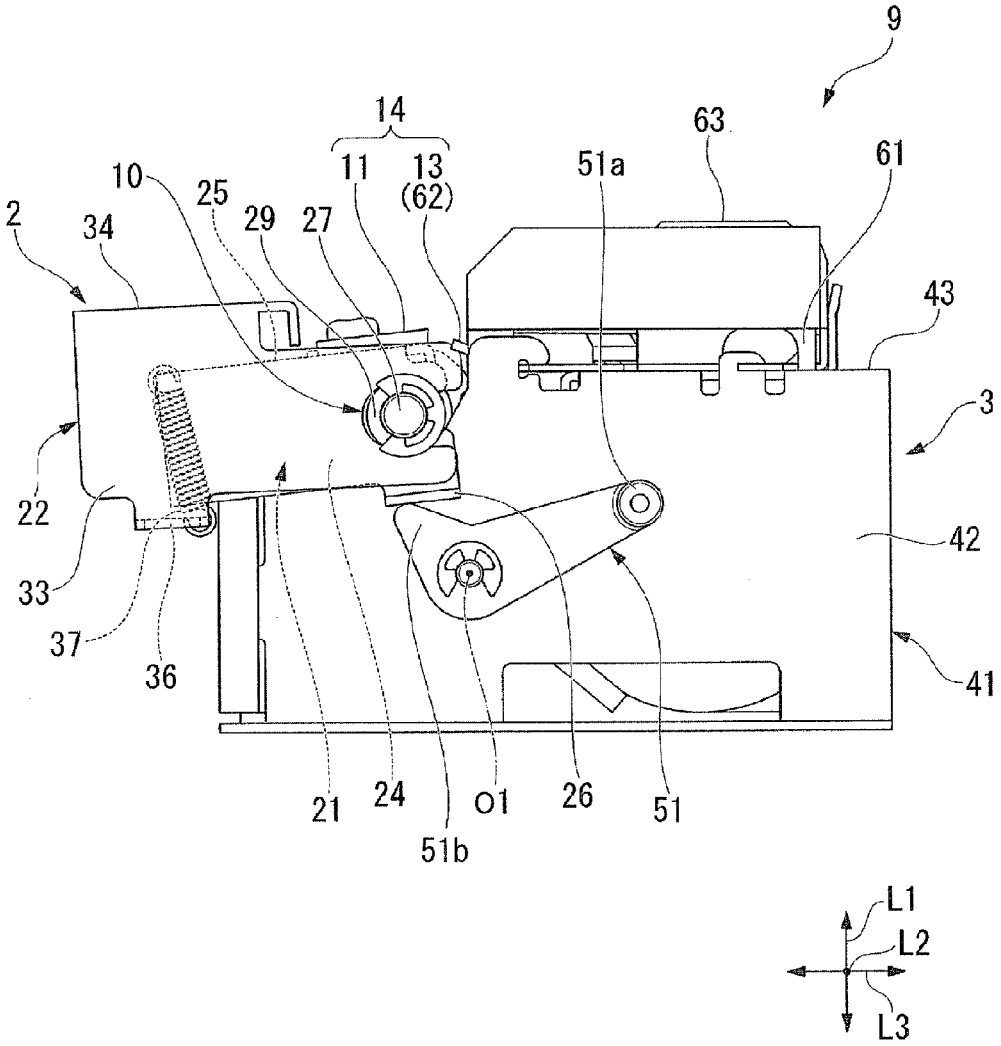
FIG. 10 is an explanatory view for illustrating an opening operation of the printer cover, which is a side view corresponding to FIG. 3.

Next, the opening operation of the printer cover 6 is described. FIG. 10 is an explanatory view for illustrating the opening operation of the printer cover 6, and is a side view corresponding to FIG. 3. As illustrated in FIG. 10, when the lever member (not shown) provided to the casing main body 5 is operated, the releasing lever 51 pivots about the pivot axis O1 in conjunction with the operation of the lever member. Then, the abutment piece 51*b* of the releasing lever 51 pushes up the platen unit 2 through an intermediation of the projecting piece 26. Specifically, as illustrated in FIG. 9, the platen frame 21 first pivots upward about each of the abutment portions 47 as the fulcrum with respect to the subframe 22. Then, the platen roller 10 is disengaged from the engagement concave portions 44 while the outer circumferential surface of the roller main body 28 is pressing the thermal head 12 in the direction against the biasing force of the head biasing member 57. At this time, through the movement of the bearings 29 for the platen roller 10 over the stopper portions 45 as illustrated in FIG. 7 and FIG. 8, the bearings 29 and the stopper portions 45 are disengaged from each other to release the combination between the platen unit 2 and the head unit 3. Thereafter, by pulling up the printer cover 6 as illustrated in FIG. 1, the printer cover 6 is located at the opened position.

In this case, the platen frame 21 is biased by the pressure-applying mechanisms 37 toward the abutment portions 47. Therefore, when the platen frame 21 is pushed up by the releasing lever 51, an abutment state between the platen frame 21 and the abutment portions 47 is maintained to prevent the platen frame 21 from being lifted up from the abutment portions 47. Therefore, a push-up force exerted by the releasing lever 51 on the projecting piece 26 (shaft support portion 24 on one end side) is transmitted to the shaft support portion 24 on the other end side through the coupling portion 25. As a result, both the bearings 29 of the platen roller 10 are disengaged from the engagement concave portions 44.

As described above, according to this embodiment, the push-up force of the releasing lever 51 can be efficiently transmitted to both the shaft support portions 24. Therefore, the occurrence of "single-side opening" can be suppressed to reliably separate the head unit 2 and the platen unit 3 from each other. In this case, reinforcement of the printer cover 6 or the lock arms, which are hitherto required, are not required. Therefore, the number of components and manufacturing costs can be prevented from increasing. In addition, the platen unit 2 (platen frame 21) and the head unit 3 come into abutment against each other through the abutment portions 47. Therefore, the platen unit and the head unit can be kept at the same potential to prevent the occurrence of secondary discharge. Further, the pressure-applying mechanisms 37 are interposed between the platen frame 21 and the subframe 22. Therefore, the printing unit 9 can be mounted into the casing 4 in a state in which the pressure-applying mechanisms 37 are mounted. As a result, as compared with the case where, for example, the pressure-applying mechanisms 37 are interposed between the printer cover 6 and the platen unit 2, mountability in mounting of the printing unit 9 into the casing 4 can be improved.

Further, in this embodiment, when the platen frame 21 is pushed up by the releasing lever 51, the releasing lever 51 presses the portion of the platen frame 21, which is located on the side closer to the platen roller 10 with respect to the abutment portions 47, whereas the pressure-applying mechanisms 37 press the portions of the platen frame 21, which are located on the side opposite to the platen roller 10 with respect to the abutment portions 47. According to this configuration, the abutment state between the platen frame 21 and the abutment portions 47 can be reliably maintained to more efficiently transmit the push-up force of the releasing lever 51 to both the shaft support portions 24.

Further, the platen frame 21 abuts against the abutment portions 47 of the head unit 3. Therefore, the platen unit 2 and the head unit 3 are positioned in the predetermined positions in the state in which the platen unit 2 and the head unit 3 are mounted. The fixed blade 13 provided to the platen frame 21 can be positioned with high accuracy with respect to the movable blade 11 provided to the head unit 3 regardless of positional accuracy of the movable blade 11 with respect to the printer cover 6. As a result, excellent cutting performance of the cutter mechanism 14 can be provided.

Further, the subframe 22 is supported by the platen frame 21 through an intermediation of the platen roller 10. Therefore, as compared with a case where the subframe 22 is supported by the platen frame 21 through an intermediation of a member other than the platen roller 10, the number of components can be prevented from increasing.

In addition, in the thermal printer 1 of this embodiment, the printer includes the above-mentioned printing unit 9. Therefore, excellent operability can be provided, while the number of components and manufacturing costs are prevented from increasing.

Note that, the technical scope of the present invention is not limited to the above-mentioned embodiment, but various modifications can be made without departing from the gist of the present invention.

For example, the configuration in which the pressure-applying mechanisms 37 press the portions of the platen frame 21, which are located on the side opposite to the platen roller 10 with respect to the abutment portions 47, has been described in the embodiment described above. However, the configuration is not limited thereto. The positions to be pressed may be appropriately changed in design as long as the configuration is configured to apply the pressure on the platen frame 21 toward the abutment portions 47. Further, the configuration in which the fixed blade 13 is provided to the platen frame 21 and the movable blade 11 is provided to the head frame 41 has been described in the embodiment described above. However, the configuration is not limited thereto. Specifically, a configuration in which the movable blade 11 is provided to the platen frame 21 and the fixed blade 13 is provided to the head frame 41 may also be used.

Further, the configuration including the plurality of pressure-applying mechanisms 37 has been described in the embodiment described above. However, the configuration is not limited thereto. The number of pressure-applying mechanisms 37 may be one. Further, although the configuration using the coil springs as the pressure-applying mechanisms 37 has been described as the above-mentioned configuration, the design may be appropriately changed as long as the configuration is configured to apply the pressure to the platen frame 21 toward the abutment portions 47. Further, although the configuration in which the releasing lever 51 pushes up the platen unit 2 through an intermediation of the platen frame 21 has been described in the embodiment described above, the platen unit 2 may be pushed up through an intermediation of the platen roller 10.

Further, the configuration in which the platen frame 21 is supported movably by the subframe 22 and the pressure-applying mechanisms 37 are interposed between the platen frame 21 and the subframe 22 has been described in the embodiment described above. However, the configuration is not limited thereto. A configuration without the subframe 22 may also be used.

Figure 11:
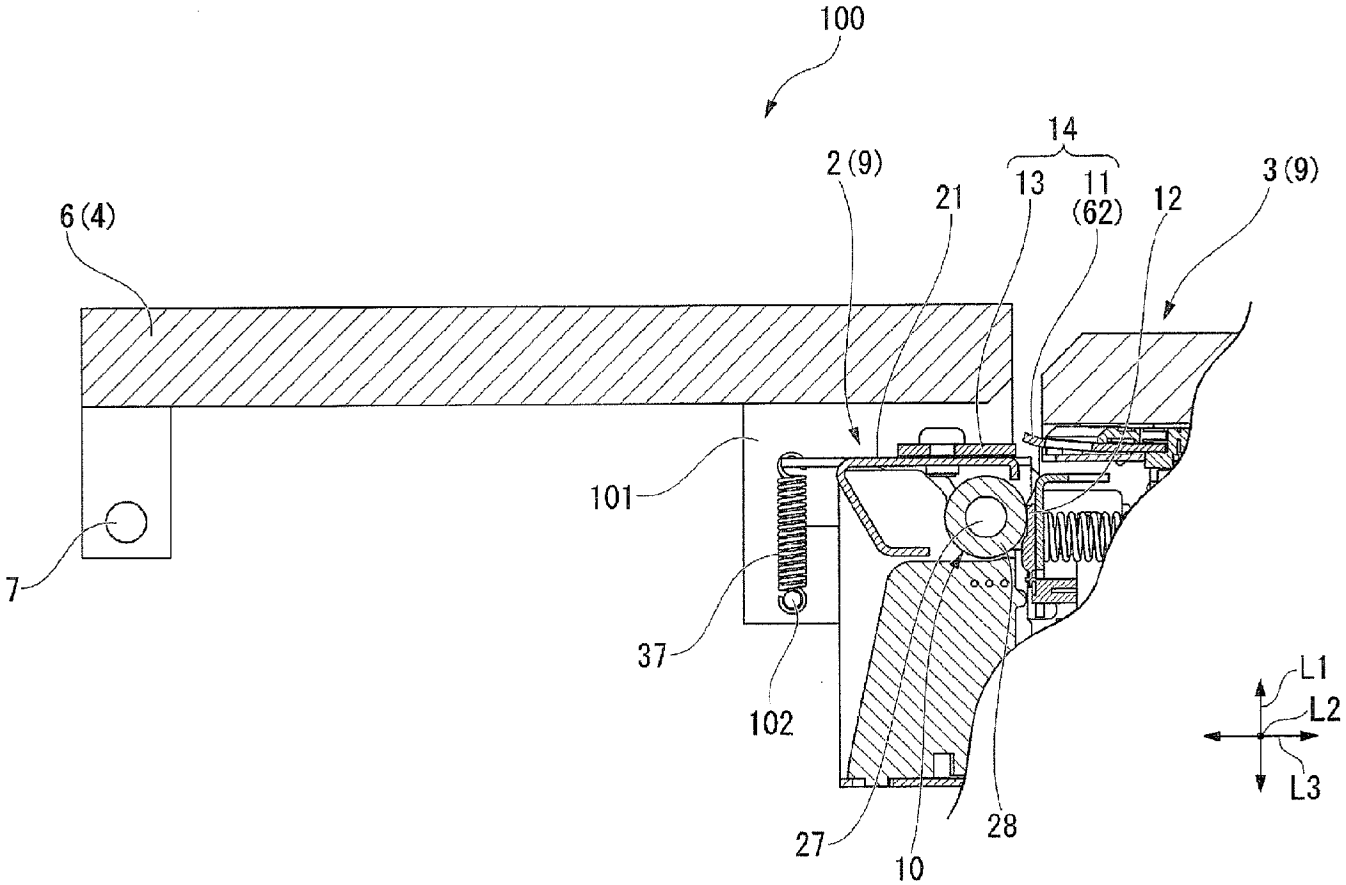
FIG. 11 is a sectional view of a thermal printer having another configuration according to the embodiment of the present invention.

For example, as illustrated in FIG. 11, the platen frame 21 may be supported movably by the printer cover 6, and the pressure-applying mechanisms 37 may be interposed between the platen frame 21 and the printer cover 6. Specifically, a thermal printer 100 illustrated in FIG. 11 includes a pair of stays 101 that is provided so as to extend downward from both ends of a distal end portion of the printer cover 6 in the horizontal direction L2. The bearings 29 (see FIG. 6) for the platen roller 10 are individually inserted loosely into the stays 101. With this configuration, the printer cover 6 supports the platen frame 21 so as to be rotatable and movable in a plane orthogonal to the horizontal direction L2 through an intermediation of the platen roller 10. Further, a boss 102 that is provided so as to project inward in the horizontal direction L2 is formed on the other end portion of each of the stays 101 in the longitudinal direction L3.

The pair of pressure-applying mechanisms 37 for biasing (applying a pressure on) the platen frame 21 about the platen shaft 27 in the direction of moving the platen frame 21 away from the printer cover 6 (downward) is interposed between the platen frame 21 and the printer cover 6.

According to the configuration described above, the same actions and effects as those of the embodiment described above are provided. In addition, the platen unit 2 is supported movably by the printer cover 6. Therefore, as compared with the case where the subframe is additionally interposed between the platen frame 21 and the printer cover 6, the number of components can be advantageously reduced.

Besides the above, the components in the above-mentioned embodiments may be replaced by well-known components as appropriate without departing from the gist of the present invention. The above-mentioned modified examples may be combined with each other as appropriate.

What is claimed is:

1. A printing unit comprising:

a head unit including a thermal head on which a plurality of heating elements are arranged;

a platen unit configured to cooperate with the head unit to perform printing on a recording sheet, the platen unit being moveable relative to the head unit between a mounted position in which the platen unit is mounted on the head unit and a released position in which the platen unit is separated from the head unit;

the platen unit including a platen frame configured to pivotably support a platen roller and configured to press the recording sheet against the thermal head for printing when the platen unit is in the mounted position;

the head unit further including a receiving mechanism configured to receive the platen roller therein when the platen unit is in the mounted position, the receiving mechanism comprising a stopper configured to hold the platen roller in the receiving mechanism;

the platen unit further including a subframe loosely connected to the platen frame so that the platen frame is rotatable and shiftable relative to the subframe, wherein the subframe movably supports the platen frame through intermediation of the platen roller;

the head unit further including an abutment portion configured to contact the platen frame when the platen unit is in the mounted position;

the head unit further including a releasing mechanism on one lateral end side thereof and configured to press the platen frame on the one lateral end side in a direction in which the platen roller leaves the receiving mechanism; and a pressure-applying mechanism connected to the platen frame and the subframe and configured to urge the platen frame on the abutment portion, wherein the pressure-applying mechanism has sufficient strength to keep the platen frame in contact with the abutment portion while the platen roller is leaving the receiving mechanism until the platen roller clears the stopper.

2. A printing unit according to claim 1, wherein the releasing mechanism comprises a releasing lever on the one lateral end side of the head unit, and the pressure-applying mechanism is configured to urge the platen frame on the other lateral end side.

3. A printing unit according to claim 2, further comprising:

a fixed blade on one of the head unit and the platen frame; and a movable blade on the other of the head unit and the platen frame for movement relative to the fixed blade to the recording sheet in cooperation with the fixed blade.

4. A printing unit according to claim 1, further comprising:

a fixed blade on one of the head unit and the platen frame; and a movable blade on the other of the head unit and the platen frame for movement relative to the fixed blade to cut the recording sheet in cooperation with the fixed blade.

5. A printer comprising the printing unit according to claim 3, wherein the head unit is mounted to a casing main body including a recording sheet receiving portion configured to receive the recording sheet therein, and the platen unit is mounted to a printer cover to which the subframe is attached, the printer cover being pivotably coupled to the casing main body through a hinge to open and close the recording sheet receiving portion.

6. A printer comprising the printing unit according to claim 1, wherein the head unit is mounted to a casing main body including a recording sheet receiving portion configured to receive the recording sheet therein, and the platen unit is mounted to a printer cover to which the subframe is attached, the printer cover being pivotably coupled to the casing main body through a hinge to open and close the recording sheet receiving portion.

7. A printer comprising:

a casing main body including a recording sheet receiving portion configured to receive a recording sheet therein;

a printer cover pivotably coupled to the casing main body through a hinge to open and close the recording sheet receiving portion;

a head unit mounted to the casing main body and including a thermal head on which a plurality of heating elements are arranged;

a platen unit mounted to the printer cover and configured to cooperate with the head unit to perform printing on a recording sheet, the platen unit being moveable relative to the head unit between a mounted position in which the platen unit is mounted on the head unit and a released position in which the platen unit is separated from the head unit;

the platen unit including a platen frame configured to pivotably support a platen roller that is configured to press the recording sheet against the thermal head for printing when the platen unit is in the mounted position;

a receiving mechanism configured to receive the platen roller therein when the platen unit is in the mounted position, the receiving mechanism comprising a stopper configured to hold the platen roller in the receiving mechanism;

the platen unit further including a subframe loosely connected to the platen frame through intermediation of the platen roller so that the platen frame is rotatable and shiftable relative to the subframe;

the head unit further including an abutment portion configured to contact the platen frame when the platen unit is in the mounted position;

the head unit further including a releasing mechanism on one lateral end side thereof and configured to press the platen frame on the one lateral end side in a direction in which the platen roller leaves the receiving mechanism; and a pressure-applying mechanism connecting the platen frame and the subframe and configured to urge the platen frame on the abutment portion, wherein the pressure-applying mechanism has sufficient strength to keep the platen frame in contact with the abutment portion while the platen roller is leaving the receiving mechanism until the platen roller clears the stopper.

8. A printer according to claim 7, wherein the releasing mechanism comprises a releasing lever on the one lateral end side of the head unit, and the pressure-applying mechanism is configured to urge the platen frame on the other lateral end side.

9. A printer unit according to claim 8, further comprising:

a fixed blade on one of the head unit and the platen frame; and a movable blade on the other of the head unit and the platen frame for movement relative to the fixed blade to cut the recording sheet in cooperation with the fixed blade.

10. A printer according to claim 7, further comprising:

a fixed blade on one of the head unit and the platen frame; and a movable blade on the other of the head unit and the platen frame for movement relative to the fixed blade to cut the recording sheet in cooperation with the fixed blade.

* * * * *